US010174904B2

(12) United States Patent
Singleton et al.

(10) Patent No.: US 10,174,904 B2
(45) Date of Patent: Jan. 8, 2019

(54) GROUNDED LIGHT ASSEMBLY

(71) Applicant: Valeo North America, Inc., Troy, MI (US)

(72) Inventors: Mark Singleton, Seymour, IN (US); Brian Hunt, Columbus, IN (US); Colby Darlage, Seymour, IN (US); Ziyi Li, Seymour, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 15/594,074

(22) Filed: May 12, 2017

(65) Prior Publication Data

US 2018/0328566 A1 Nov. 15, 2018

(51) Int. Cl.

| | |
|---|---|
| ***F21V 7/00*** | (2006.01) |
| ***F21S 45/10*** | (2018.01) |
| ***F21S 41/19*** | (2018.01) |
| ***F21S 41/37*** | (2018.01) |

(52) U.S. Cl.
CPC ..... *F21S 45/10* (2018.01); *F21S 41/192* (2018.01); *F21S 41/37* (2018.01)

(58) Field of Classification Search
CPC ..... F21V 7/00; F21S 6/00
USPC ..... 362/297, 296.01, 257, 549
See application file for complete search history.

(56) References Cited

U.S. PATENT DOCUMENTS

| | | | | |
|---|---|---|---|---|
| 5,474,473 | A | 12/1995 | Perretta et al. | |
| 2008/0070444 | A1 | 3/2008 | Blasko et al. | |
| 2011/0074958 | A1* | 3/2011 | Pastrick | B60Q 1/2665 348/148 |
| 2016/0356447 | A1* | 12/2016 | Yamamoto | F21S 41/147 |
| 2017/0267179 | A1* | 9/2017 | Herrmann | B60R 1/081 |

* cited by examiner

*Primary Examiner* — Edwyn Labaze
(74) *Attorney, Agent, or Firm* — Oblon, McClelland, Maier & Neustadt, L.L.P.

(57) ABSTRACT

A light assembly to ground electronic elements, including a platform that supports a front part of the electronic elements; a housing that supports the electronic elements and the platform, the housing having an anchor that protrudes from the housing to support the platform, a plurality of ridges that protrudes from the housing to support a back part of the electronic elements, a back and a front reflective layers that cover the plurality of ridges and the anchor; and a connector that provides electrical connections between each electronic elements. The front and back reflective layers provide grounding for the electronic elements via the plurality of ridges and the anchor, the connector provides electrical connections between the electronic elements and the back reflective layer, and the platform support provides retaining of the electrical connections provided by the connector.

17 Claims, 8 Drawing Sheets

GROUNDED LIGHT ASSEMBLY

BACKGROUND

Field of the Disclosure

The present disclosure relates to a grounding system and in particular to automotive light grounding system.

Description of the Related Art

Unwanted electrical discharges can travel throughout different elements of an automobile and may generate short circuits that potentially cause damages and/or failures. This is particularly relevant for lighting assemblies that are prone to unwanted electrical discharges coming from the external environment which can easily damage electronic elements that are essential for operating the lighting assemblies, e.g. printed circuit boards (PCB), light emitting diodes (LED). For example, these unwanted electrical discharges can be collected on a body of the automobile and find their way into the lighting assemblies though metallic fastening devices, e.g. screws, and/or bolts, that are essential to affix the lighting assemblies onto the body of the automobile.

To limit damage due to unwanted electrical discharges and protect the electronic elements, conventional grounding systems that rely on supplementary conductive structures connected to the electronic elements have been adopted.

Although such conventional grounding systems are widely used, they present important drawbacks. Notably in lighting assemblies for automobiles, the supplementary conductive structures used in the conventional grounding systems may be cost prohibitive. For example, the incorporation of supplementary metallic structures, e.g. metallic plaques and/or wires may require modifications, e.g. design restructuration, soldering of new elements, may increase manufacturing cost of the lighting assemblies. Furthermore, the conductive structures may not provide sufficient electrical contacts to efficiently ground the electrical elements as variations in manufacturing may affect surface contacts between the electrical elements and the supplementary conductive structures.

Thus, a light assembly solving the aforementioned limitations is desired.

SUMMARY

Accordingly, the object of the present disclosure is to provide a light assembly for grounding electronic elements which overcomes the above-mentioned limitations.

The light assembly of the present disclosure provides sufficient electrical contact and minimizes modification of the light assembly by relying on structures that are already present in the light assembly to fulfill other functions than the one of grounding, such as reflective elements and/or mounting/fastening elements.

In one non-limiting illustrative example, a light assembly to ground electronic elements is presented. The light assembly includes a platform that provides support to a front part of the electronic elements; a housing that provides support to the electronic elements and to the platform, the housing including: an anchor that protrudes from the housing to support the platform, a plurality of ridges that protrudes from the housing to support a back part of the electronic elements, a back reflective layer that covers the anchor to reflect light, and a front reflective layer connected to the back reflective layer that covers the plurality of ridges to reflect light; and a connector that provides electrical connections between each electronic elements of the electronic elements, wherein the front reflective layer further provides grounding for the electronic elements via the plurality of ridges, wherein the back reflective layer further provides grounding for the electronic elements via the anchor, wherein the connector further provides electrical connections between the electronic elements and the back reflective layer, and wherein the platform further provides maintaining of the electrical connections provided by the connector.

In another non-limiting illustrative example, a light assembly to ground electronic elements is presented. The light assembly includes a platform that provides support to a front part of the electronic elements; a housing that provides support to the electronic elements and to the platform, the housing including: an anchor that protrudes from the housing to support the platform, a plurality of ridges that protrudes from the housing to support a back part of the electronic elements, and a reflective layer that covers the anchor and the plurality of ridges to reflect light; and a connector that provides electrical connections between each electronic elements of the electronic elements, wherein the reflective layer further provides grounding for the electronic elements, wherein the connector further provides electrical connections between the electronic elements and the reflective layer, and wherein the platform further provides maintaining of the electrical connections provided by the connector.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
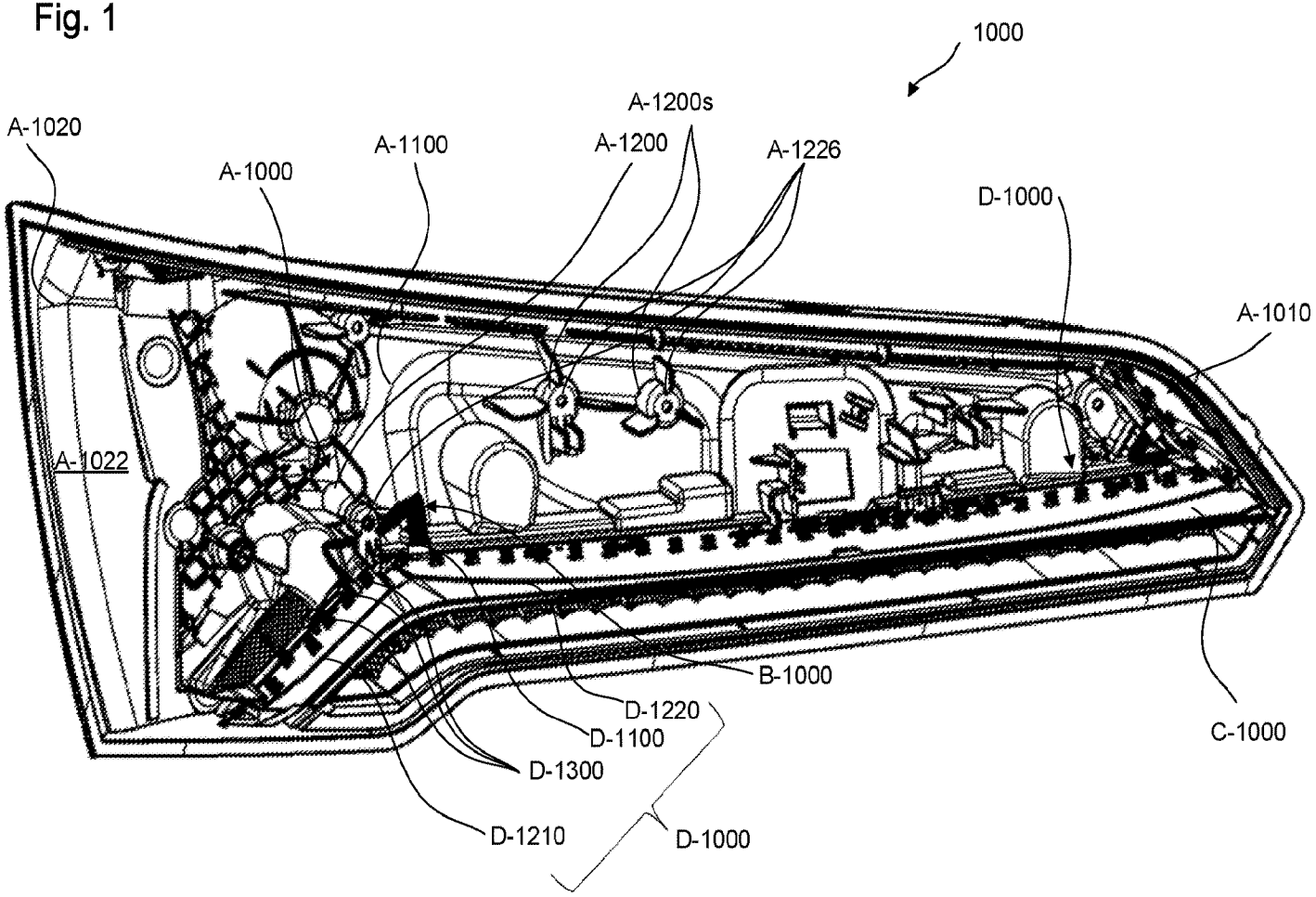
FIG. 1 is a perspective view of a light assembly with a housing, according to certain aspects of the disclosure.

All publications, patent applications, patents, and other references mentioned herein are incorporated by reference in their entirety. Further, the materials, methods, and examples discussed herein are illustrative only and are not intended to be limiting.

In the drawings, like reference numerals designate identical or corresponding parts throughout the several views. Further, as used herein, the words "a", "an", and the like include a meaning of "one or more", unless stated otherwise. The drawings are generally drawn not to scale unless specified otherwise or illustrating schematic structures or flowcharts.

FIG. 1 is a perspective view of a light assembly 1000 with a housing A-1000, according to certain aspects of the disclosure.

The light assembly 1000 can be inserted into a body of a vehicle to house, support, and provide different lighting elements and/or functions. The light assembly 1000 can include a housing A-1000 coated with a reflective layer A-1100 to provide specific optical performances, e.g. reflectivity, electronic elements D-1000 such as printed circuit boards (PCB) D-1200 to support light sources D-1300, e.g. light-emitting diodes (LED), and a connector B-1000 to electrically connect the electronic elements D-1000 between each other, and the platform support C-1000 affixed to the housing A-10000 to support the electronic elements D-1000.

The light assembly 1000 provides a grounding system for the electronic elements D-1000 while minimizing manufacturing cost by adding functionalities to elements that are necessarily present the lighting system 1000, such as the reflective layer A-1100, the connector B-1000, and/or the platform support C-1000.

To achieve the specific optical performances the reflective layer A-1100 can be metalized, e.g. polished aluminum, In addition to provide the optical performances, the metallization of the reflective layer A-1100 provides grounding for the electrical elements D-1000 by acting as a electrical conductor and an electrical sink.

In addition to connect the electronic elements D-1000 between each other, the connector B-1000 can provide electrical connections between the electronic elements D-1000 and the reflective layer A-1100 and can open an electric path from the electronic elements D-1000 to the reflective layer A-1100.

In addition to support the electronic elements D-1000 the platform support C-1000 can force the electrical connections between the electronic elements D-1000 and the reflective layer A-1100 provided by the connector B-1000.

FIGS. 2A-2D are perspective views of an anchor A-1200 of the housing A-1000, a reflective layer A-1100 of the housing A-1000 with a platform support C-1000 of the light assembly 1000 and with electronic elements D-1000 of the light assembly 1000, the reflective layer A-1100 with the platform support C-1000 and without the electronic elements D-1000, the reflective layer A-1100 without the platform support C-1000 and without the electronic elements D-1000, respectively and according to certain aspects of the disclosure.

Figure 2A:
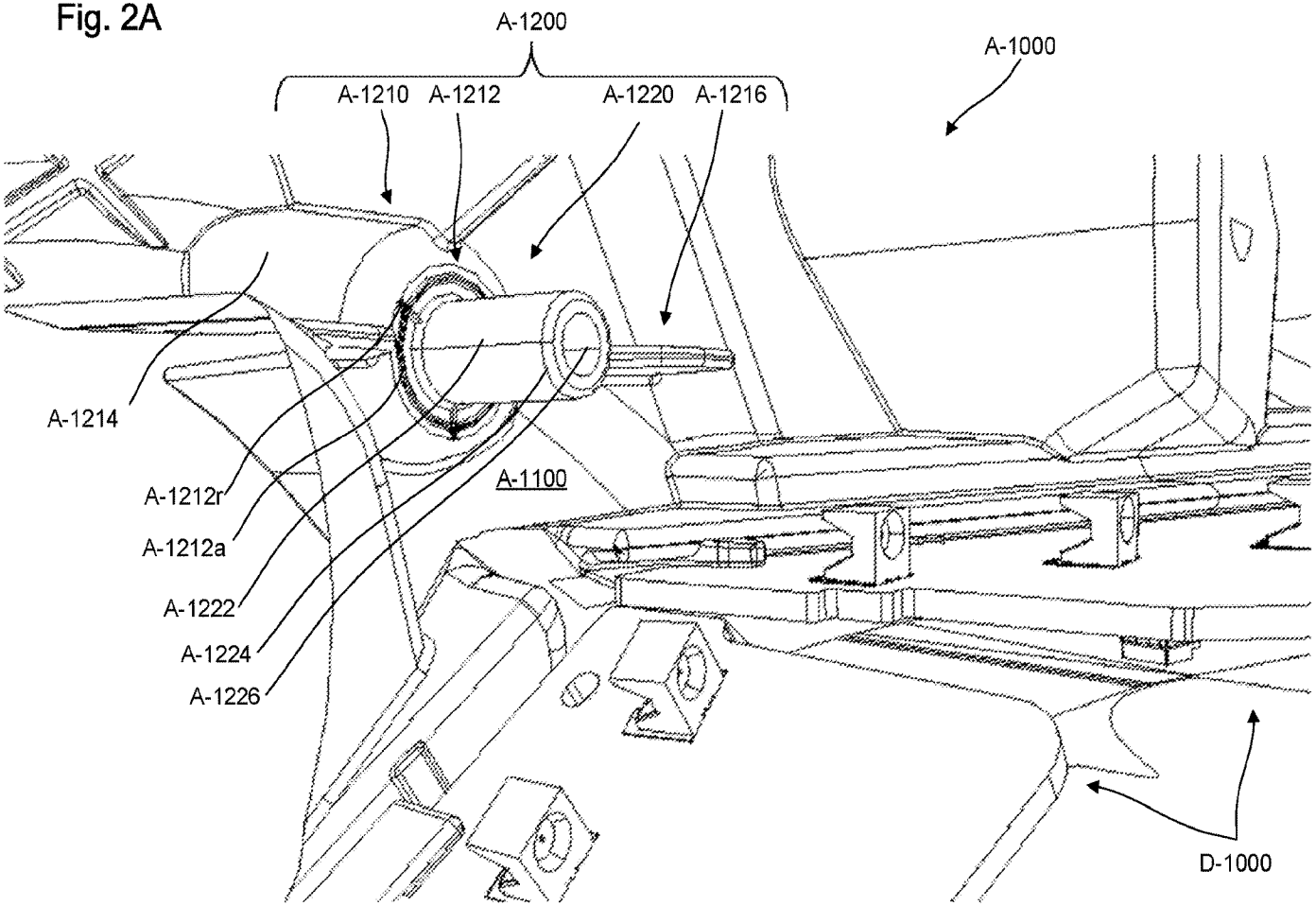
FIG. 2A is a perspective view of an anchor of the housing, according to certain aspects of the disclosure.
Figure 2B:
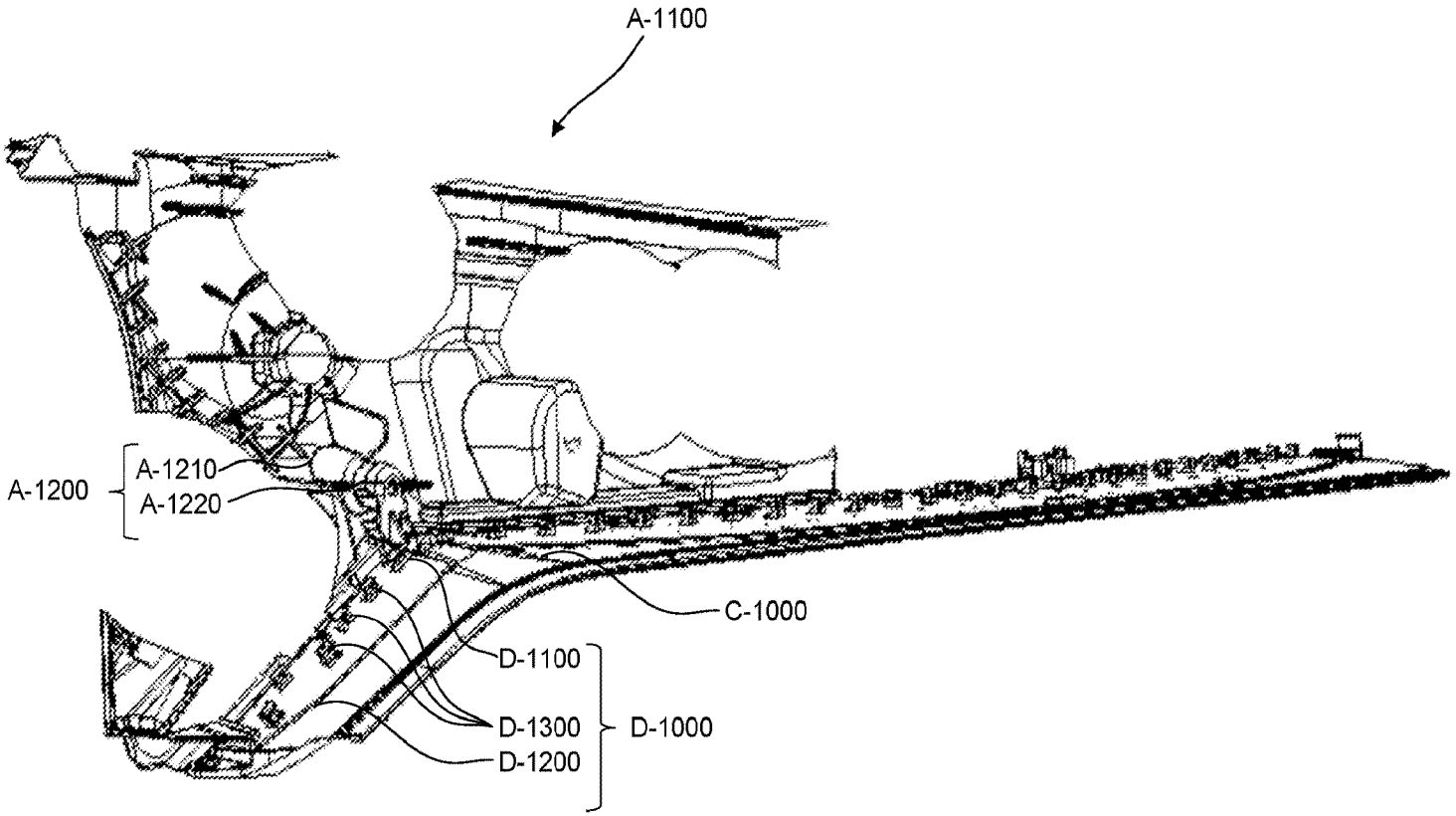
FIG. 2B is a perspective view of a reflective layer of the housing with a platform support of the light assembly and with electronic elements of the light assembly, according to certain aspects of the disclosure.
Figure 2C:
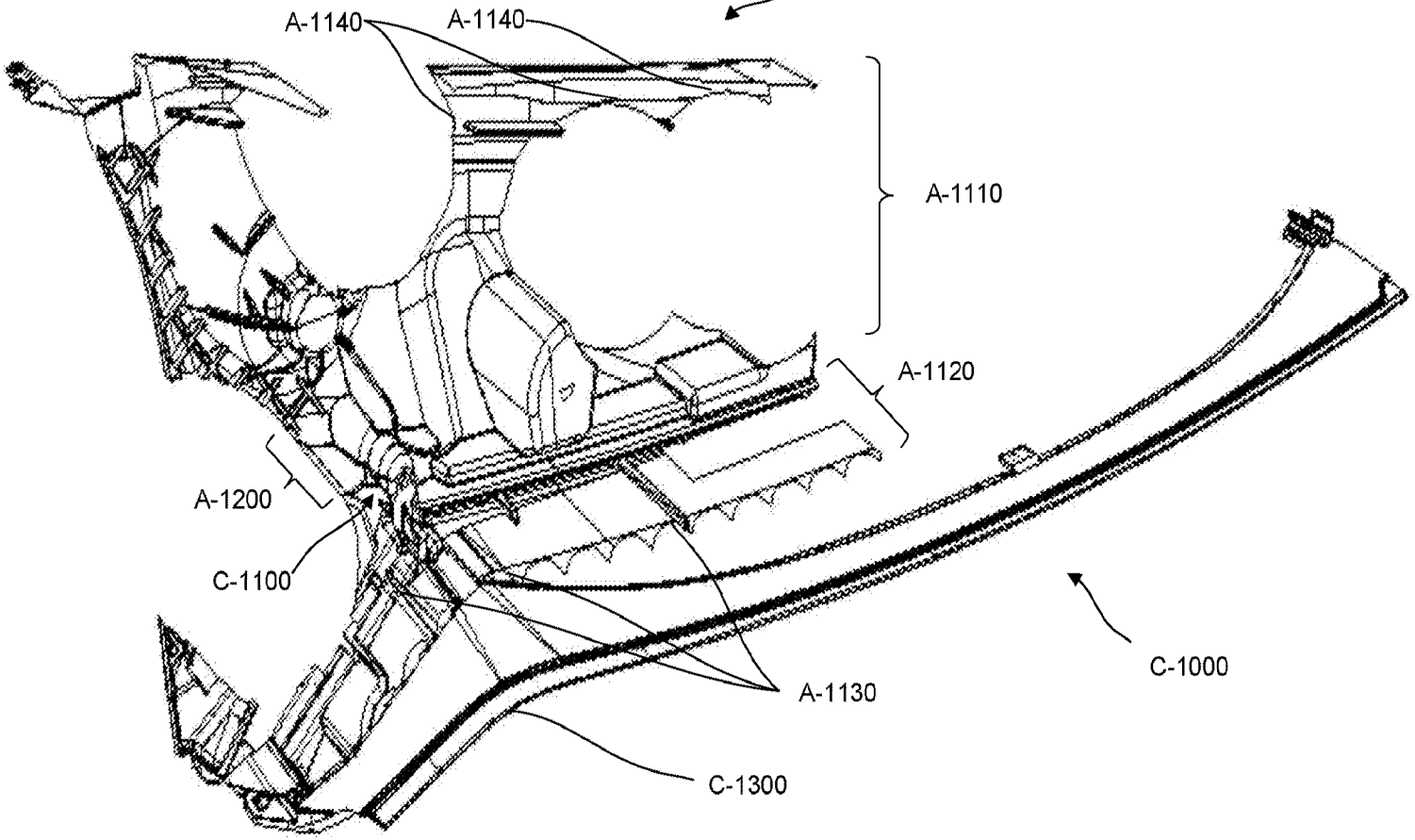
FIG. 2C is a perspective view of the reflective layer of the housing with the platform support of the light assembly and without the electronic elements of the light assembly, according to certain aspects of the disclosure.

The housing A-1000 can include an anchor A-1200 that protrudes in a forward direction from the housing A-1000 to provide attachment to the platform support C-1000, a plurality of ridges A-1130 that protrudes in vertical direction to provide support to the electronic elements D-1000, as illustrated in FIG. 2C, and the conductive layer A-1100 that can cover the anchor A-1200 and the plurality of ridges A-1130.

Figure 3:
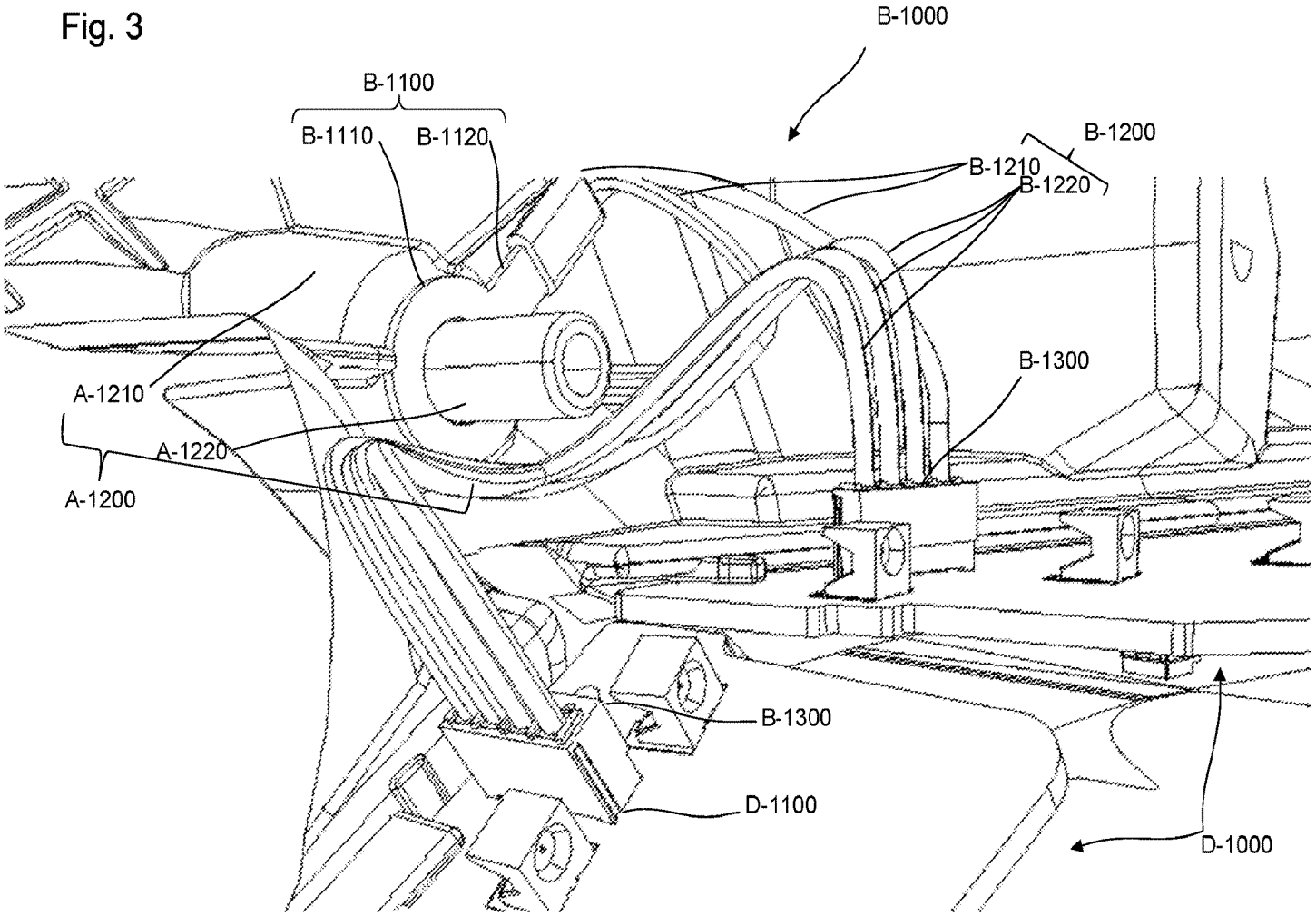
FIG. 3 is a perspective view of a connector in contact with the anchor, according to certain aspects of the disclosure.

The anchor A-1200 of the housing A-1000 can include a seat A-1210 that protrudes from the housing A-1000 and a boss A-1220 that protrudes from the seat A-1210 to receive and contact a terminal B-1100 of the connector B-1000, as illustrated in FIG. 3.

The seat A-1210 of the anchor A-1200 can include a body A-1214 that protrudes from the housing A-1000, reinforcement legs A-1216 placed radially around the body A-1214 and affixed to the housing A-1000 to provide reinforcement, and a crash ring A-1212 that protrudes from a terminal end of the body A-1214.

The crash ring A-1212 of the seat A-1210 can have physical characteristics to enhance contact between the connector B-1000, as illustrated in FIG. 3, and the conductive layer A-1100 and prevent contact failure that may be due to oxidation or manufacturing tolerance, e.g. plastic molding variations. For example, the crash ring A-1212 of the seat A-1210 can include an annulus A-1212*a* that surrounds the boss A-1220 and radial elements A-1212*r* that radially extend through the annulus A-1212*a*. The annulus A-1212*a* and the radial elements A-1212*r* of the crash ring A-1212 can have dimensions to prevent contact failure. For example, the annulus A-1212*a* and the radial elements A-1212*r* of the crash ring A-1212 can have predetermined heights between 0.1 mm and 1 mm, and preferably between 0.25 mm and 0.75 mm and predetermined widths between 0.1 mm and 1 mm, and preferably between 0.25 mm and 0.75 mm.

Figure 4A:
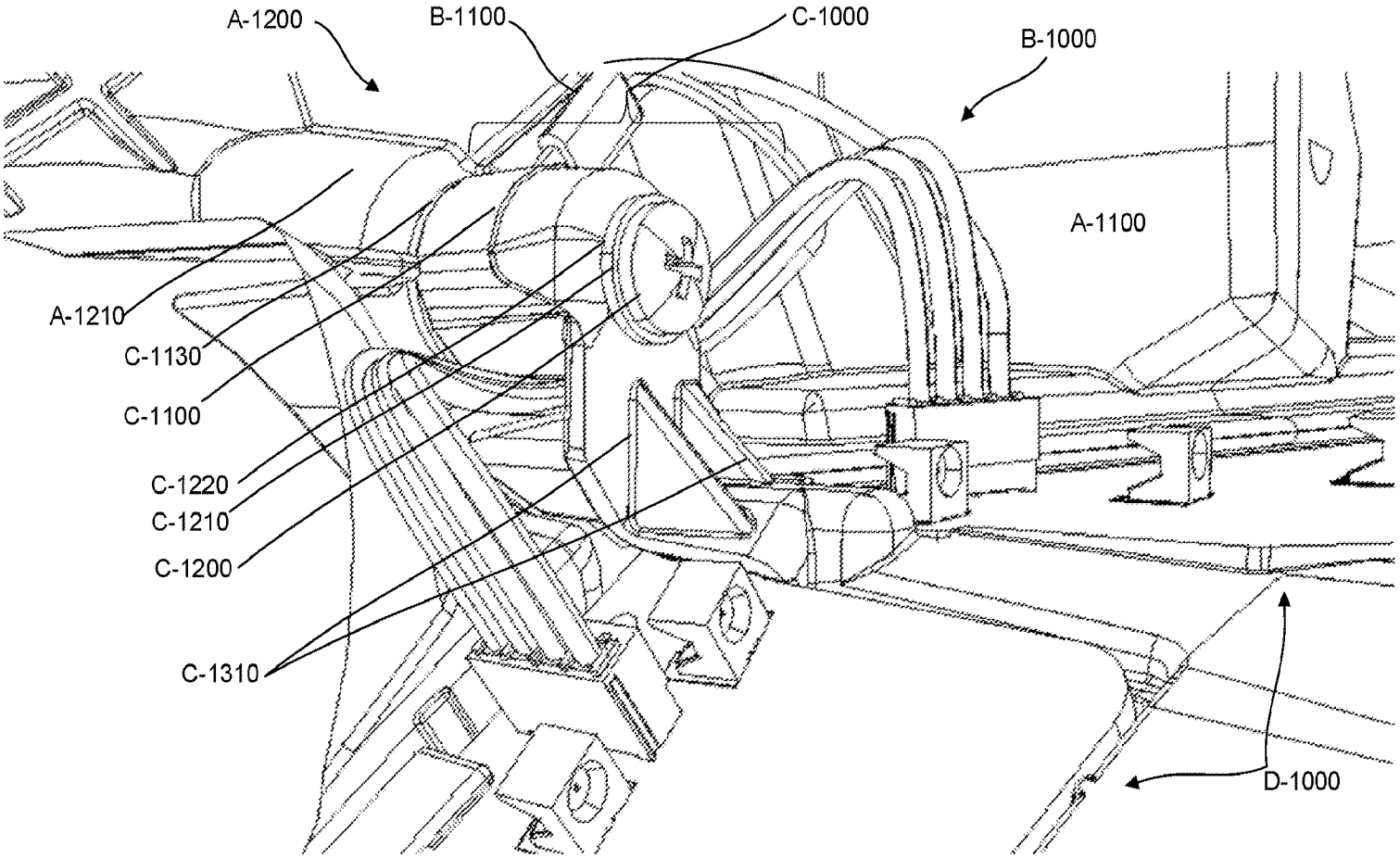
FIG. 4A is a perspective view of the platform support affixed to the anchor and in contact with the connector, according to certain aspects of the disclosure.
Figure 4B:
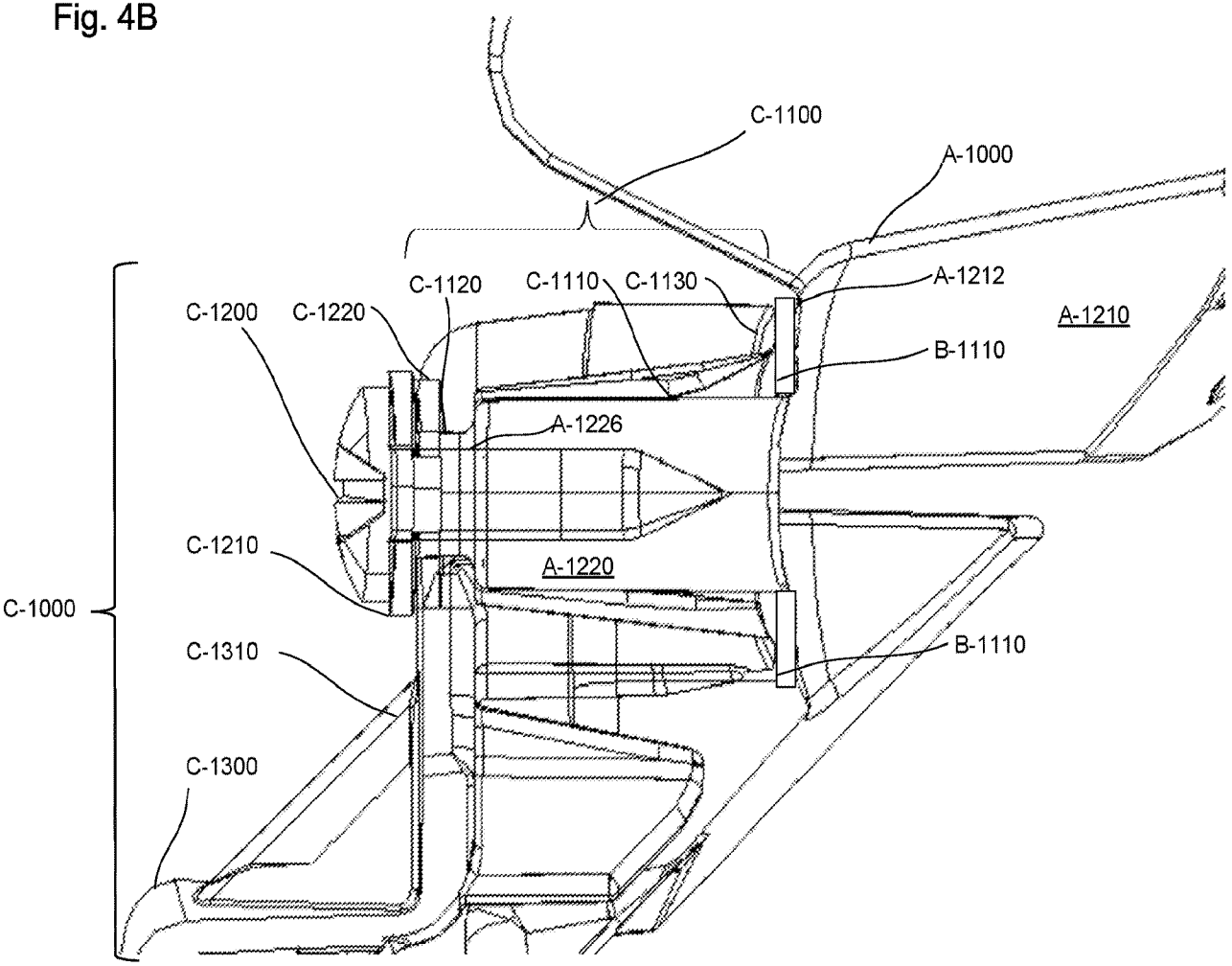
FIG. 4B is a sectional view of the platform support affixed to the anchor and in contact with the connector, according to certain aspects of the disclosure.

The boss A-1220 of the anchor A-1200 can have a neck A-1222 ended by a bevel end A-1224 and a hole A-1226 that goes along a longitudinal length of the neck A-1222. The neck A-1222 of the boss A-1220 can receive the terminal B-1100 of the connector B-1000, illustrated in FIG. 3, to generate contacts between the connector B-1000 and the conductive layer A-1100 and the hole A-1226 of the boss A-1220 can receive a fastening device C-1200 of the platform support C-1000 to fasten the terminal B-1100 of the connector B-1000 against the seat A-1210, via the platform support C-1000 inserted on the boss A-1220, as illustrated in FIGS. 4A-4B.

The anchor A-1200 of the housing A-1000 can be molded from the housing A-1000 or machined in one or several pieces assembled together and fasten onto the housing A-1000 using fastening devices such as screws, bolts, adhesives or the combination thereof.

Figure 2D:
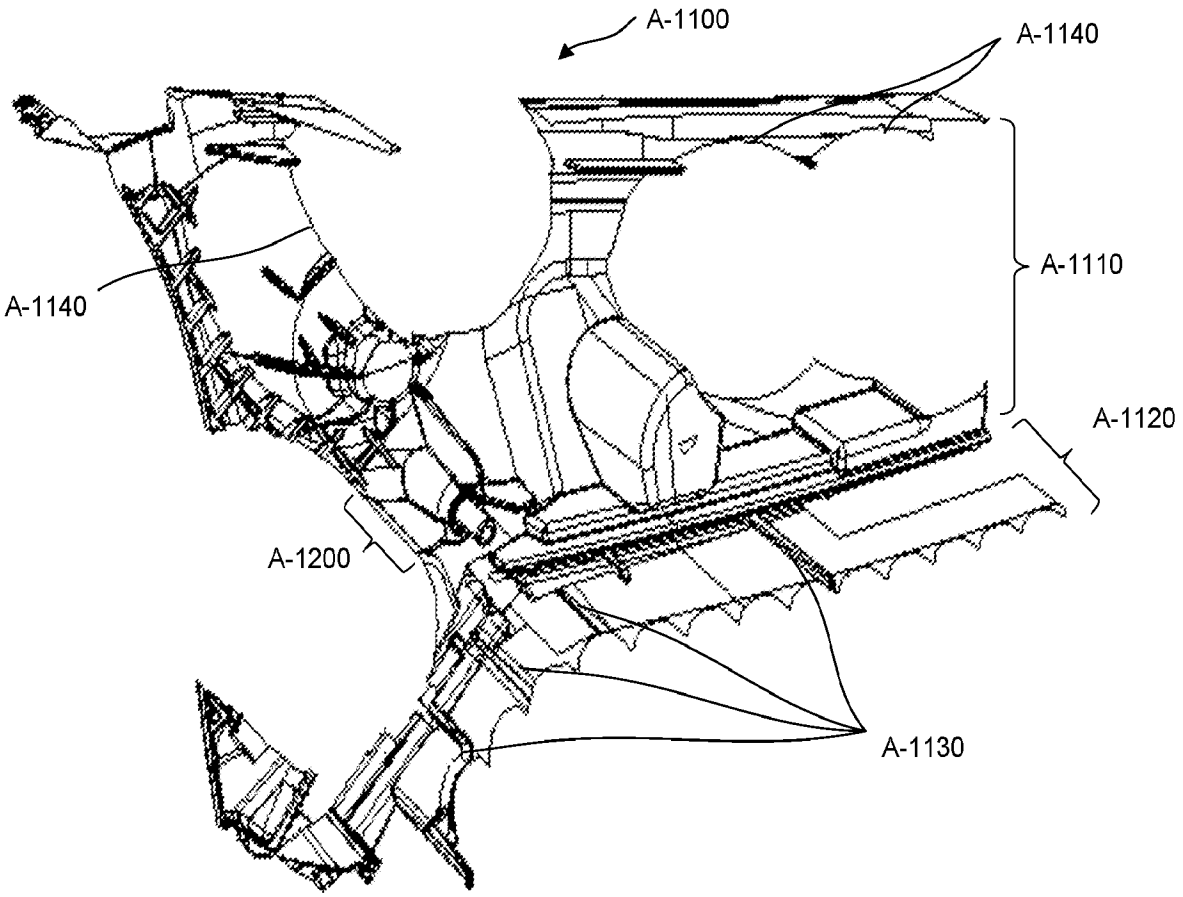
FIG. 2D is a perspective view of the reflective layer of the housing without the platform support of the light assembly and without the electronic elements of the light assembly, according to certain aspects of the disclosure.

The reflective layer A-1100 can include a back reflective layer A-1110 connected to a front reflective layer A-1120, as illustrated in FIGS. 2B-2D.

The back reflective layer A-1110 can be localized behind the electronic elements D-1000 to cover an external surface of the anchor A-1200 and extend from the anchor A-1200 towards boundaries of the housing A-1000. In addition, the back reflective layer A-1110 can include cut out sections A-1140 to prevent unwanted electrical connections with lighting elements that are not supported by electronic elements D-1000 such as high beam assemblies.

The front reflective layer A-1120 can be localized below the electronic elements D-1000 to cover an external surface of the plurality ridges A-1130 and be in contact with the electronic elements D-1000 and ground the electronic elements D-1000.

FIG. 3 is a perspective view of the connector B-1000 in contact with the anchor A-1200, according to certain aspects of the disclosure.

The connector B-1000 can include the terminal B-1100, plugs B-1300 removably affixed the electronic elements D-1000, and electrical wires B-1200 that connects the plugs B-1300 to the terminal B-1100.

The electrical wires B-1200 can include inter PCB wires B-1210 that connect the electronic elements D-1000 between each other and ground wires B-1220 that connect ground ports D-1100 of the electronic elements D-1000 to the reflective layer A-1100 via the terminal B-1100.

The terminal B-1100 of the connector B-1000 can include a conductive tap B-1110 shaped to be inserted through the boss A-1220 of the anchor A-1200 and be placed between the seat A-1210 of the anchor A-1200 and the platform support C-1000, illustrated in FIGS. 4A-4B, and a protrusion B-1120 in contact with the ground wires B-1220 of the electrical wires B-1200. For example, the terminal B-1100 of the connector B-1000 can be a ring terminal, as illustrated in FIG. 3, a spade terminal, a hook terminal, or the like to match a cylindrical shape of the boss A-1220 of the anchor A-1200.

The ground wires B-1210 of the electrical wires B-1200 can electrically connect the ground ports D-1100 of the electronic elements D-1000 between each other and electrically connect the terminal B-1100 of the connector B-1000 with the ground ports D-1100 of the electronic elements D-1000.

FIGS. 4A-4B are a perspective and a sectional views of the platform support C-1000 affixed to the anchor A-1200 and in contact with the connector B-1000, according to certain aspects of the disclosure.

The platform support C-1000 is affixed to the housing A-1000 via the anchor A-1200 and supports a front part of the electronic elements D-1000 via a tongue C-1300 that runs along a length of the electronic elements D-1000 while a back part of the electronic elements D-1000 is supported by the plurality of ridges A-1130 of the housing A-1000, see FIG. 2C.

In addition to provide support to the electronic elements D-1000 the platform support C-1000 provides electrical connections between the electronic elements D-1000 and the reflective layer A-1100 by forcing the terminal B-1100 of the connector B-1000 against the reflective layer A-1100 and by contacting the back part of the electronic elements D-1000 to the plurality of ridges A-1130. The back part of the electronic elements D-1000 can include a plurality of contact areas in contact with the plurality of ridges A-1130. The plurality of contact areas may be uncovered metalized areas, e.g. uncovered copper plaques, placed on the back part of the electronic elements D-1000 to provide electrical connections between the electronic elements D-1000 and the reflective layer A-1100.

The platform support C-1000 can include a bezel C-1100 insertable around the boss A-1220 of the anchor A-1200 and fastenable against the seat A-1210 of the anchor A-1200 to affix the platform support C-1000 to the housing A-1000 and to force the terminal B-1100 against the reflective layer A-1100. The bezel C-1100 of the platform support C-1000 can include a cavity C-1110 to receive the boss A-1220 of the anchor A-1200, an opening C-1120 that goes through the cavity C-1110 to receive the fastening device C-1200, and a contact surface C-1130 around the cavity C-1110 to contact the terminal B-1100 of the connector B-1000. The fastening device C-1200 can go through the opening C-1120 and thread into the hole A-1226 of the boss A-1220 to sandwich the conductive tap B-1110 of the terminal B-1100 between the contact surface C-1130 of the boss A-1220 and the crash ring A-1212 of the anchor A-1200 in order to assure electrical connections between the electronic elements D-1000 and the conductive layer A-1100.

The bezel C-1100 of the platform support C-1000 can be molded or machined in one or several pieces assembled together and made from non-conductive materials with sufficient structural strength to maintain the conductive tap B-1110 of the terminal B-1100 against of the crash ring A-1212 of the anchor A-1200. For example, the bezel C-1100 may be made from Delrin alloys and/or other polymer alloys.

The tongue C-1300 of the platform support C-1000 can be placed below the anchor A-1200 and affixed to the bezel C-1100 via support brackets C-1310 that protrudes from the bezel C-1100.

In addition, the platform support C-1000 can include a seal C-1220 surmounted by a washer C-1210 and inserted between the fastening device C-1200 and the opening C-1120 of the bezel C-1100 to increase the fastening of the platform support C-1000 onto the anchor A-1200. In addition, the seal C-1220 may prevent unwanted electrical connections and/or water infiltrations from occurring.

The light assembly 1000 grounds the electronic elements D-1000 through the connector B-1000 that connects the electronic elements D-1000 to the conductive layer A-1100 that coats the housing A-1000 and through the platform support C-1000 that maintains the connector B-1000 in contact with the conductive layer A-1100. In other words, unwanted electrical charges that travel through the housing A-1000 are captured by the conductive layer A-1100 and transferred to the ground ports D-1100 of the electronic elements D-1000 through the connector B-1000. Similarly, unwanted electrical charges can be evacuated from the electronic elements D-1000 to the conductive layer A-1100 through the connector B-1000.

The foregoing discussion discloses and describes merely exemplary embodiments of an object of the present disclosure. As will be understood by those skilled in the art, an object of the present disclosure may be embodied in other specific forms without departing from the spirit or essential characteristics thereof. Accordingly, the present disclosure is intended to be illustrative, but not limiting of the scope of an object of the present disclosure as well as the claims.

Numerous modifications and variations on the present disclosure are possible in light of the above teachings. It is therefore to be understood that within the scope of the appended claims, the disclosure may be practiced otherwise than as specifically described herein.

What is claimed is:

1. A light assembly to ground electronic elements, comprising:

a platform that provides support to a front part of the electronic elements;

a housing that provides support to the electronic elements and to the platform, the housing including:

an anchor that protrudes from the housing to support the platform, the anchor including a seat that protrudes from the housing, and a boss that protrudes from the seat, a plurality of ridges that protrudes from the housing to support a back part of the electronic elements, a back reflective layer that covers the anchor to reflect light, and a front reflective layer connected to the back reflective layer that covers the plurality of ridges to reflect light; and a connector that provides electrical connections between each electronic elements of the electronic elements, wherein the front reflective layer further provides grounding for the electronic elements via the plurality of ridges, wherein the back reflective layer further provides grounding for the electronic elements via the anchor, wherein the connector further provides electrical connections between the electronic elements and the back reflective layer, wherein the platform further provides maintaining of the electrical connections provided by the connector, and wherein the seat further includes a crash ring that enhances a contact between the connector and the conductive layer.

2. The light assembly of claim 1, wherein the crash ring includes an annulus that surrounds the boss and radial elements that radially extend through the annulus to enhance the contact.

3. The light assembly of claim 2, wherein the annulus and the radial elements have heights between 0.1 mm and 1 mm.

4. The light assembly of claim 1, wherein the seat further includes reinforcement legs placed radially around the seat that provides support for the seat.

5. A light assembly to ground electronic elements, comprising:

a platform that provides support to a front part of the electronic elements;

a housing that provides support to the electronic elements and to the platform, the housing including:

an anchor that protrudes from the housing to support the platform, the anchor including a seat that protrudes from the housing, and a boss that protrudes from the seat, a plurality of ridges that protrudes from the housing to support a back part of the electronic elements, a back reflective layer that covers the anchor to reflect light, and a front reflective layer connected to the back reflective layer that covers the plurality of ridges to reflect light; and a connector that provides electrical connections between each electronic elements of the electronic elements, wherein the front reflective layer further provides grounding for the electronic elements via the plurality of ridges, wherein the back reflective layer further provides grounding for the electronic elements via the anchor, wherein the connector further provides electrical connections between the electronic elements and the back reflective layer, wherein the platform further provides maintaining of the electrical connections provided by the connector, and wherein the platform further includes a bezel with an opening and a fastening device to be inserted through the opening and threaded into a hole of the boss to fasten the platform on the anchor.

6. The light assembly of claim 5, wherein the platform further includes a seal.

7. The light assembly of claim 5, wherein the connector includes a terminal that goes through the boss and contacts the seat, plugs inserted onto the electronic elements, and electrical wires that electrically connects the terminal and the plugs.

8. The light assembly of claim 7, wherein the electrical wires includes ground wires that connect ground ports of the electronic elements to the terminal.

9. The light assembly of claim 8, wherein the bezel presses the terminal against the seat via the fastening device.

10. The light assembly of claim 7, wherein the boss has cylindrical shape and the terminal has an opening that matches the cylindrical shape.

11. The light assembly of claim 5, wherein the seat further includes reinforcement legs placed radially around the seat that provides support for the seat.

12. A light assembly to ground electronic elements, comprising:

a platform that provides support to a front part of the electronic elements;

a housing that provides support to the electronic elements and to the platform, the housing including:

an anchor that protrudes from the housing to support the platform, a plurality of ridges that protrudes from the housing to support a back part of the electronic elements, and a reflective layer that covers the anchor and the plurality of ridges to reflect light; and a connector that provides electrical connections between each electronic elements of the electronic elements, wherein the reflective layer further provides grounding for the electronic elements, wherein the connector further provides electrical connections between the electronic elements and the reflective layer, wherein the platform further provides maintaining of the electrical connections provided by the connector, wherein the anchor includes a seat that protrudes from the housing, and a boss that protrudes from the seat, and wherein the platform further includes a bezel with an opening and a fastening device to be inserted through the opening and into a hole of the boss to fasten the platform on the anchor.

13. The light assembly of claim 12, wherein the reflective layer is made of aluminum to reflect light and conduct electricity.

14. The light assembly of claim 13, wherein the reflective layer further includes cut out sections to prevent electrical connections with lighting elements that are not supported by electronic elements.

15. The light assembly of claim 12, wherein the connector includes a terminal that goes through the boss and contacts the seat, plugs inserted onto the electronic elements, and electrical wires that electrically connects the terminal and the plugs.

16. The light assembly of claim 15, wherein the electrical wires includes ground wires that connect ground ports of the electronic elements to the terminal.

17. The light assembly of claim 16, wherein the bezel presses the terminal against the seat via the fastening device.

* * * * *